US011157029B1

(12) United States Patent
Liu et al.

(10) Patent No.: US 11,157,029 B1
(45) Date of Patent: Oct. 26, 2021

(54) VOLTAGE REGULATOR AND SILICON-BASED DISPLAY PANEL

(71) Applicant: SEEYA OPTRONICS CO., LTD., Shanghai (CN)

(72) Inventors: Ping-lin Liu, Shanghai (CN); Chih-pu Yeh, Shanghai (CN)

(73) Assignee: SEEYA OPTRONICS CO., LTD., Shanghai (CN)

( * ) Notice: Subject to any disclaimer, the term of this patent is extended or adjusted under 35 U.S.C. 154(b) by 0 days.

(21) Appl. No.: 17/316,881

(22) Filed: May 11, 2021

(30) Foreign Application Priority Data

May 12, 2020 (CN) ..... 202010394861.8

(51) Int. Cl.
*G05F 1/575* (2006.01)
*G09G 3/20* (2006.01)

(52) U.S. Cl.
CPC ..... *G05F 1/575* (2013.01); *G09G 3/20* (2013.01); *G09G 2300/0426* (2013.01); *G09G 2330/02* (2013.01)

(58) Field of Classification Search
None
See application file for complete search history.

(56) References Cited

U.S. PATENT DOCUMENTS

2021/0173422 A1* 6/2021 Sorace ..... G05F 1/575

FOREIGN PATENT DOCUMENTS

| | | | |
|---|---|---|---|
| CN | 104102260 | A | 10/2014 |
| CN | 207926997 | U | 9/2018 |
| CN | 109873404 | A | 6/2019 |
| CN | 110098830 | A | 8/2019 |
| JP | 2019121413 | A | 7/2019 |

* cited by examiner

*Primary Examiner* — Duane N Taylor, Jr.
(74) *Attorney, Agent, or Firm* — Duane Morris LLP

(57) ABSTRACT

A voltage regulator includes an error amplification circuit, a voltage detection circuit, a loop current prevention circuit, a voltage regulation circuit, and a stable voltage output terminal; the voltage regulation circuit outputs a voltage of the second power supply to the stable voltage output terminal when receiving a first control signal and second control signal output by the voltage detection circuit and stops outputting the voltage of the second power supply when receiving a third control signal and fourth control signal output by the voltage detection circuit; the loop current prevention circuit prevents a loop from being formed between the first power supply and the stable voltage output terminal when receiving the first control signal and the second control signal and controls the error amplification circuit to output an error amplification signal to the stable voltage output terminal when receiving the third control signal and the fourth control signal.

18 Claims, 8 Drawing Sheets

VOLTAGE REGULATOR AND SILICON-BASED DISPLAY PANEL

CROSS-REFERENCE TO RELATED APPLICATION

This application claims priority to Chinese Patent Application No. 202010394861.8 filed May 12, 2020, the disclosure of which is incorporated herein by reference in its entirety.

TECHNICAL FIELD

The present disclosure relates to the field of circuits and, in particular, to a voltage regulator and a silicon-based display panel.

BACKGROUND

A voltage regulator is a power supply circuit or a power supply device capable of automatically regulating an output voltage. The function of the voltage regulator is to stabilize a power voltage that fluctuates relatively greatly and does not meet the requirements of a circuit device within a set value range of the voltage regulator so that various circuits or devices can operate normally at a rated operating voltage.

Currently, the voltage regulator applied to various electronic products such as a mobile phone and a television may be a low-dropout voltage regulator, for example. The voltage outputted from the low-dropout voltage regulator is related to a power supply at an input of the low-dropout voltage regulator. Only when the power supply at the input of the voltage regulator reaches a corresponding voltage value, the voltage regulator can output a stable power voltage from the output. However, if the input of the voltage regulator does not reach the corresponding voltage value, the voltage regulator outputs a voltage of 0 V. In this manner, when another voltage stabilizing power supply in a load circuit electrically connected to the output of the voltage regulator needs to cooperate with the voltage outputted from the voltage regulator to implement the corresponding function, a misoperation occurs since the voltage regulator outputs a voltage of 0 V at the initial time of power-up, which affects the normal operation of a load and even damages the load.

SUMMARY

Embodiments of the present disclosure provide a voltage regulator and a silicon-based display panel, so as to enable the voltage regulator to output a stable voltage signal, avoid a misoperation of a load circuit electrically connected to the voltage regulator, and improve the operation stability and reliability of the voltage regulator.

In a first aspect, the embodiments of the present disclosure provide a voltage regulator. The voltage regulator includes an error amplification circuit, a voltage detection circuit, a loop current prevention circuit, a voltage regulation circuit, and a stable voltage output terminal.

The voltage detection circuit is electrically connected to a first power supply, a second power supply, the loop current prevention circuit, and the voltage regulation circuit, separately. The voltage detection circuit is configured to output a first control signal and a second control signal to the loop current prevention circuit and the voltage regulation circuit when a voltage of the first power supply is lower than a voltage of the second power supply and output a third control signal and a fourth control signal to the loop current prevention circuit and the voltage regulation circuit when the voltage of the first power supply is higher than the voltage of the second power supply.

The voltage regulation circuit is further electrically connected between the second power supply and the stable voltage output terminal. The voltage regulation circuit is configured to output the voltage of the second power supply to the stable voltage output terminal when receiving the first control signal and the second control signal and stop outputting the voltage of the second power supply to the stable voltage output terminal when receiving the third control signal and the fourth control signal.

The loop current prevention circuit is further electrically connected to the first power supply, the error amplification circuit, and the stable voltage output terminal, separately. The loop current prevention circuit is configured to prevent a loop from being formed between the first power supply and the stable voltage output terminal when receiving the first control signal and the second control signal and control the error amplification circuit to output an error amplification signal to the stable voltage output terminal when receiving the third control signal and the fourth control signal, where a voltage of the error amplification signal is higher than the voltage of the second power supply.

In a second aspect, the embodiments of the present disclosure further provide a silicon-based display panel. The silicon-based display panel includes a silicon-based substrate, a display unit, and a voltage regulator described above.

The voltage regulator and the display unit are formed on the silicon-based substrate and the voltage regulator is configured to provide a stable voltage signal for the display unit.

The embodiments of the present disclosure provide the voltage regulator and the silicon-based display panel. The voltage detection circuit detects the voltage of the first power supply and the voltage of the second power supply; when detecting that the voltage of the first power supply is lower than the voltage of the second power supply, the voltage detection circuit outputs the first control signal and the second control signal to the loop current prevention circuit and the voltage regulation circuit so that the voltage regulation circuit outputs the voltage of the second power supply to the stable voltage output terminal and the loop current prevention circuit prevents the loop from being formed between the first power supply and the stable voltage output terminal; when detecting that the voltage of the first power supply is higher than the voltage of the second power supply, the voltage detection circuit outputs the third control signal and the fourth control signal to the loop current prevention circuit and the voltage regulation circuit so that the voltage regulation circuit stops outputting the voltage of the second power supply to the stable voltage output terminal and the loop current prevention circuit controls the error amplification circuit to output the error amplification signal to the stable voltage output terminal, where the voltage of the error amplification signal is higher than the voltage of the second power supply. In this manner, the voltage of the first power supply and the voltage of the second power supply are detected in real time so that the stable voltage output terminal is controlled to output a larger voltage signal to meet the requirement of a corresponding load circuit, which can prevent the misoperation of the load circuit and device damages due to a small voltage signal outputted from the stable voltage output terminal of the voltage regulator. The voltage regulator provided by the embodiments of the present disclosure can output a voltage signal that meets the requirement of the load circuit and has relatively high operation stability and reliability.

DETAILED DESCRIPTION

Figure 1:
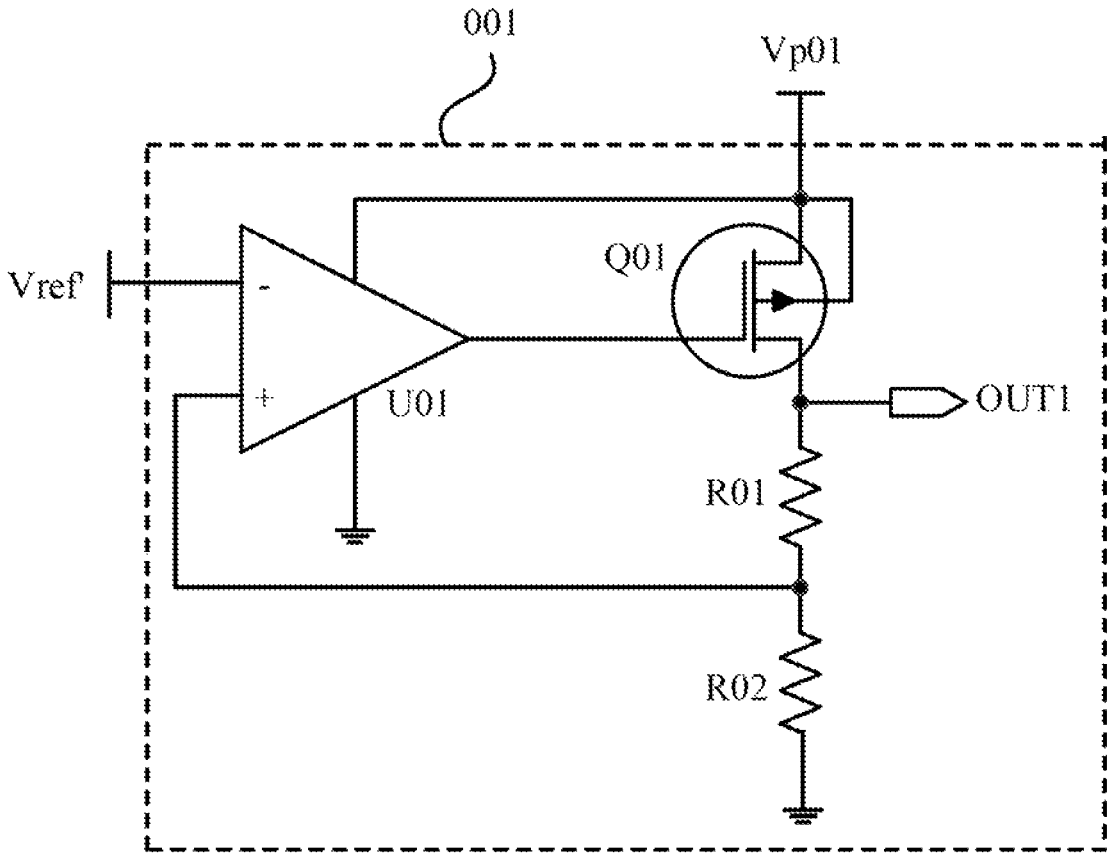
FIG. 1 is a structure diagram of a voltage regulator in the related art.

The present disclosure is further described below in detail in conjunction with drawings and embodiments. It is to be understood that the embodiments described herein are merely intended to explain the present disclosure and not to limit the present disclosure. Additionally, it is to be noted that for ease of description, merely part, not all, of the structures related to the present disclosure are illustrated in the drawings.

Figure 2:
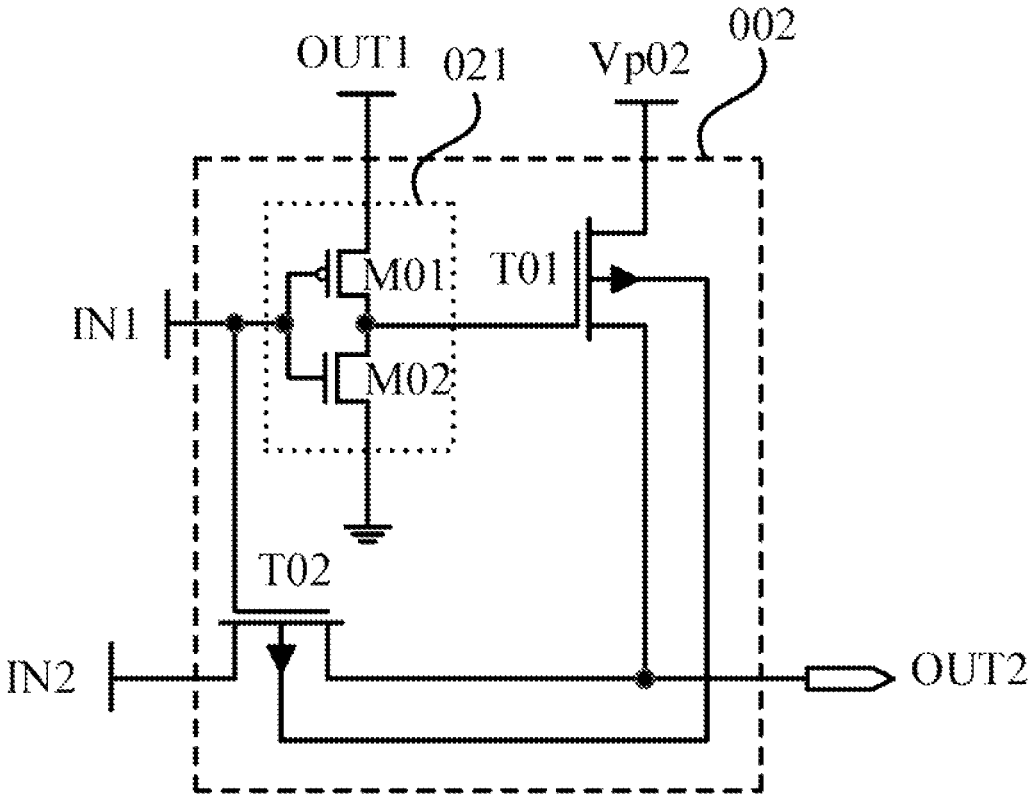
FIG. 2 is a structure diagram of a load circuit.
Figure 3:
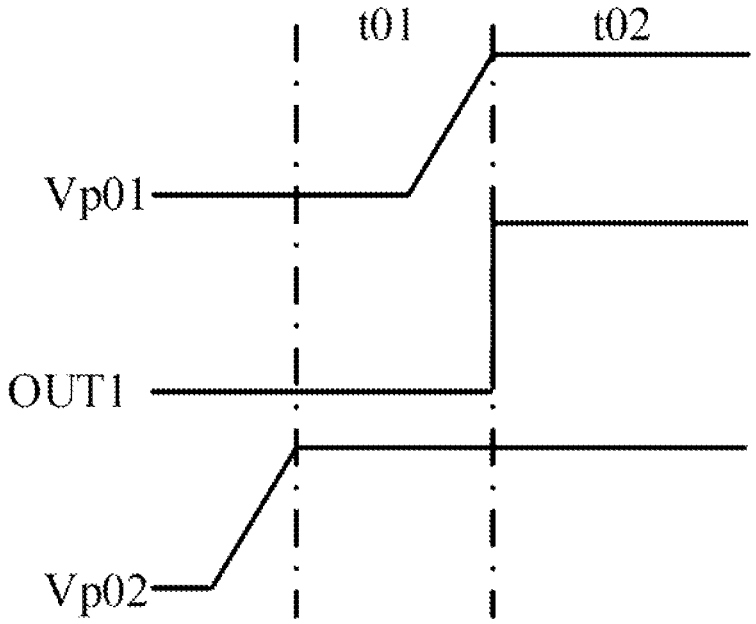
FIG. 3 is a timing diagram corresponding to FIGS. 1 and 2.

FIG. 1 is a structure diagram of a voltage regulator in the related art. FIG. 2 is a structure diagram of a load circuit. FIG. 3 is a timing diagram corresponding to FIGS. 1 and 2. As shown in FIG. 1, an output OUT1 of a voltage regulator 001 is electrically connected to a load circuit 002 to provide a stable power supply for the load circuit 002. The voltage regulator 001 includes an error amplifier U01, a power transistor Q01, and resistors R01 and R02. A power signal input terminal of the error amplifier U01 is electrically connected to a power signal Vp01. Only when the power signal Vp01 reaches an operating voltage of the error amplifier U01, can the error amplifier U01 operate and output a reference voltage signal Vref' to a gate of the power transistor Q01 to control the power transistor Q01 to be turned on so that the power signal Vp01 can output a stable power supply to the load circuit 002 through the power transistor Q01 that is turned on and the resistors R1 and R2.

As shown in FIG. 2, the load circuit 002 includes an inverter structure 021 and transistors T01 and T02, where the inverter structure 021 includes a P-type transistor M01 and an N-type transistor M02, where a gate of the P-type transistor M01 and a gate of the N-type transistor M02 are both electrically connected to a pulse signal IN1, a first electrode of the P-type transistor is electrically connected to the output OUT1 of the voltage regulator 001, and a second electrode of the P-type transistor M01 is electrically connected to a gate of the transistor T01; a first electrode of the N-type transistor M02 is grounded and a second electrode of the N-type transistor M02 is electrically connected to the gate of the transistor T01; a first electrode of the transistor T01 is electrically connected to a power signal Vp02 and a second electrode of the transistor T01 is electrically connected to an output OUT2 of the load circuit 002; a gate of the transistor T02 is electrically connected to a clock pulse signal CK1, a first electrode of the transistor T02 is electrically connected to a clock signal IN2, and a second electrode of the transistor T02 is electrically connected to the output OUT2 of the load circuit 002. In this manner, when the transistor T01 is turned on, the output OUT2 of the load circuit 002 outputs the power signal Vp02, and when the transistor T02 is turned on, the output OUT2 of the load circuit 022 outputs the clock signal IN2.

As shown in FIGS. 1, 2 and 3, in a case where the transistor T01 and the transistor T02 are both P-type transistors, at time t01, Vp01 is smaller than the operating voltage of the error amplifier U01, while Vp02 reaches a certain voltage value so that the error amplifier U01 cannot operate normally and the output OUT1 of the voltage regulator 001 outputs a low-level signal. In this case, when the pulse signal IN1 is a low-level signal, the transistor T02 is turned on, the P-type transistor M01 in the inverter structure 021 is turned on, and the low-level signal outputted from the output OUT1 of the voltage regulator 001 is outputted to the gate of the transistor T01 through the P-type transistor M01 that is turned on. Since a difference between the low-level signal outputted from the output OUT1 of the voltage regulator 001 and the power signal Vp02 is smaller than a threshold voltage of the transistor T01, the transistor T01 is turned on. That is, the transistor T01 and the transistor T02 are both turned on at time t01 and the power signal Vp02 is transmitted to the terminal of the clock signal IN2 through the transistor T01 and the transistor T02 that are turned on so that the load circuit 002 is short-circuited, thereby causing device damages. In this manner, a failure of the signal outputted from the output OUT1 of the voltage regulator 001 in the related art to meet the requirement of the normal operation of the load circuit 002 results in a misoperation of the load circuit 002 and even device damages.

To solve the preceding technical problem, the embodiments of the present disclosure provide a voltage regulator capable of outputting a stable voltage signal. The voltage regulator includes an error amplification circuit, a voltage detection circuit, a loop current prevention circuit, a voltage regulation circuit, and a stable voltage output terminal. The voltage detection circuit is electrically connected to a first power supply, a second power supply, the loop current prevention circuit, and the voltage regulation circuit, separately. The voltage detection circuit is configured to output a first control signal and a second control signal to the loop current prevention circuit and the voltage regulation circuit when a voltage of the first power supply is lower than a voltage of the second power supply and output a third control signal and a fourth control signal to the loop current prevention circuit and the voltage regulation circuit when the voltage of the first power supply is higher than the voltage of the second power supply. The voltage regulation circuit is further electrically connected between the second power supply and the stable voltage output terminal. The voltage regulation circuit is configured to output the voltage of the second power supply to the stable voltage output terminal when receiving the first control signal and the second control signal and stop outputting the voltage of the second power supply to the stable voltage output terminal when receiving the third control signal and the fourth control signal. The loop current prevention circuit is further electrically connected to the first power supply, the error amplification circuit, and the stable voltage output terminal, separately. The loop current prevention circuit is configured to prevent a loop from being formed between the first power supply and the stable voltage output terminal when receiving the first control signal and the second control signal and control the error amplification circuit to output an error amplification signal to the stable voltage output terminal when receiving the third control signal and the fourth control signal, where a voltage of the error amplification signal is higher than the voltage of the second power supply.

With the preceding technical solution, the voltage detection circuit detects the voltage of the first power supply and the voltage of the second power supply; when detecting that the voltage of the first power supply is lower than the voltage of the second power supply, the voltage detection circuit outputs the first control signal and the second control signal to the loop current prevention circuit and the voltage regulation circuit so that the voltage regulation circuit outputs the voltage of the second power supply to the stable voltage output terminal and the loop current prevention circuit prevents the loop from being formed between the first power supply and the stable voltage output terminal; when detecting that the voltage of the first power supply is higher than the voltage of the second power supply, the voltage detection circuit outputs the third control signal and the fourth control signal to the loop current prevention circuit and the voltage regulation circuit so that the voltage regulation circuit stops outputting the voltage of the second power supply to the stable voltage output terminal and the loop current prevention circuit controls the error amplification circuit to output the error amplification signal to the stable voltage output terminal, where the voltage of the error amplification signal is higher than the voltage of the second power supply. In this manner, the voltage of the first power supply and the voltage of the second power supply are detected in real time so that the stable voltage output terminal is controlled to output a larger voltage signal to meet the requirement of a corresponding load circuit, which can prevent the misoperation of the load circuit and the device damages due to a small voltage signal outputted from the stable voltage output terminal of the voltage regulator. The voltage regulator provided by the embodiments of the present disclosure can output a voltage signal that meets the requirement of the load circuit and has relatively high operation stability and reliability.

The above is the core idea of the present disclosure. Hereinafter, the technical solutions in the embodiments of the present disclosure will be described clearly and completely in conjunction with drawings in the embodiments of the present disclosure. Based on the embodiments of the present disclosure, all other embodiments obtained by those of ordinary skill in the art without creative work are within the scope of the present disclosure.

Figure 4:
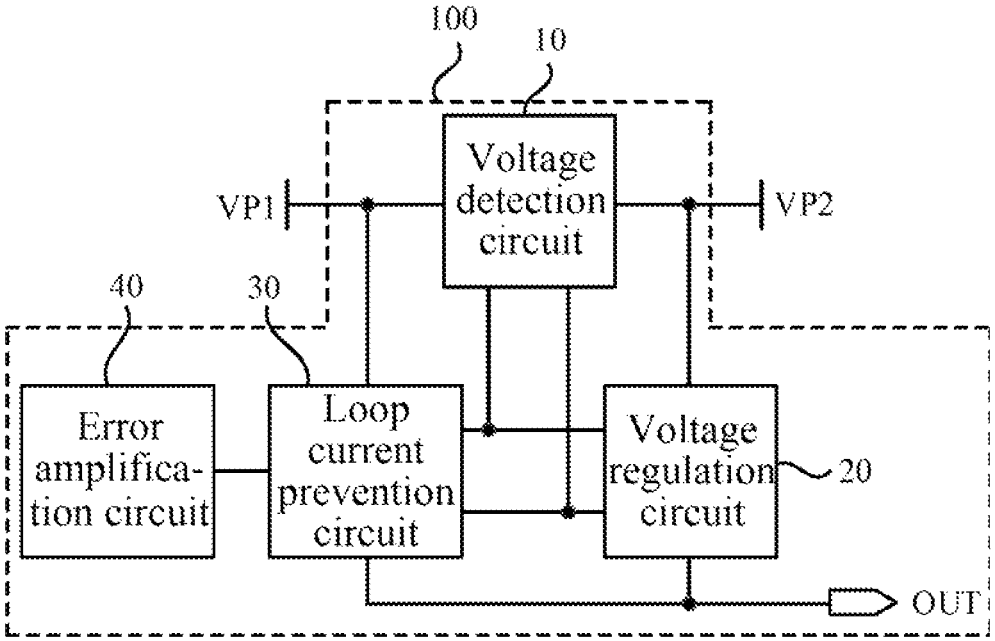
FIG. 4 is a structure diagram of a voltage regulator according to embodiments of the present disclosure.

FIG. 4 is a structure diagram of a voltage regulator according to embodiments of the present disclosure. As shown in FIG. 4, the voltage regulator 100 includes a voltage detection circuit 10, a voltage regulation circuit 20, a loop current prevention circuit 30, an error amplification circuit 40, and a stable voltage output terminal OUT. The voltage detection circuit 10 is electrically connected to a first power supply VP1, a second power supply VP2, the loop current prevention circuit 30, and the voltage regulation circuit 20, separately. The voltage detection circuit 10 is configured to output a first control signal con1 and a second control signal con2 to the loop current prevention circuit 30 and the voltage regulation circuit 20 when a voltage V1 of the first power supply VP1 is lower than a voltage V2 of the second power supply VP2 and output a third control signal con3 and a fourth control signal con4 to the loop current prevention circuit 30 and the voltage regulation circuit 20 when the voltage V1 of the first power supply VP1 is higher than the voltage V2 of the second power supply VP2. The voltage regulation circuit 20 is further electrically connected between the second power supply VP2 and the stable voltage output terminal OUT. The voltage regulation circuit 20 is configured to output the voltage V2 of the second power supply VP2 to the stable voltage output terminal OUT when receiving the first control signal con1 and the second control signal con2 and stop outputting the voltage V2 of the second power supply VP2 to the stable voltage output terminal OUT when receiving the third control signal con3 and the fourth control signal con4. The loop current prevention circuit 30 is further electrically connected to the first power supply VP1, the error amplification circuit 40, and the stable voltage output terminal OUT, separately. The loop current prevention circuit 30 is configured to prevent a loop from being formed between the first power supply VP1 and the stable voltage output terminal OUT when receiving the first control signal con1 and the second control signal con2 and control the error amplification circuit 40 to output an error amplification signal VG to the stable voltage output terminal OUT when receiving the third control signal con3 and the fourth control signal con4, where a voltage Vg of the error amplification signal VG is higher than the voltage V2 of the second power supply VP2.

Figure 5:
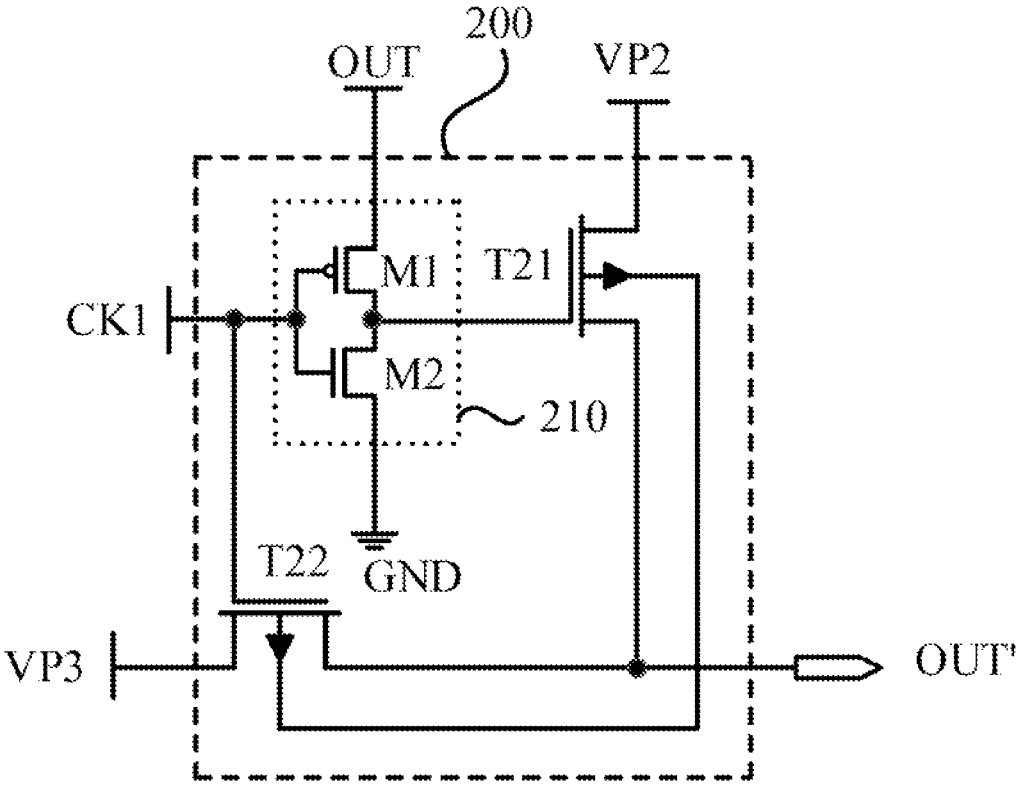
FIG. 5 is a structure diagram of a load circuit according to embodiments of the present disclosure.

Exemplarily, FIG. 5 is a structure diagram of a load circuit according to embodiments of the present disclosure. As shown in FIGS. 4 and 5, a load circuit 200 includes an inverter structure 210 and transistors T21 and T22, where the inverter structure 210 includes a P-type transistor M1 and an N-type transistor M2, where a gate of the P-type transistor M1 and a gate of the N-type transistor M2 are both electrically connected to a clock pulse signal CK1, a first electrode of the P-type transistor M1 is electrically connected to the stable voltage output terminal of the voltage regulator 100, and a second electrode of the P-type transistor M1 is electrically connected to a gate of the transistor T21; a first electrode of the N-type transistor M2 is grounded and a second electrode of the N-type transistor M2 is electrically connected to the gate of the transistor T21; a first electrode of the transistor T21 is electrically connected to the second power supply VP2 and a second electrode of the transistor T21 is electrically connected to an output OUT' of the load circuit 200; a gate of the transistor T22 is electrically connected to the clock pulse signal CK1, a first electrode of the transistor T22 is electrically connected to a third power supply VP3, and a second electrode of the transistor T22 is electrically connected to the output OUT' of the load circuit 200.

Figure 6:
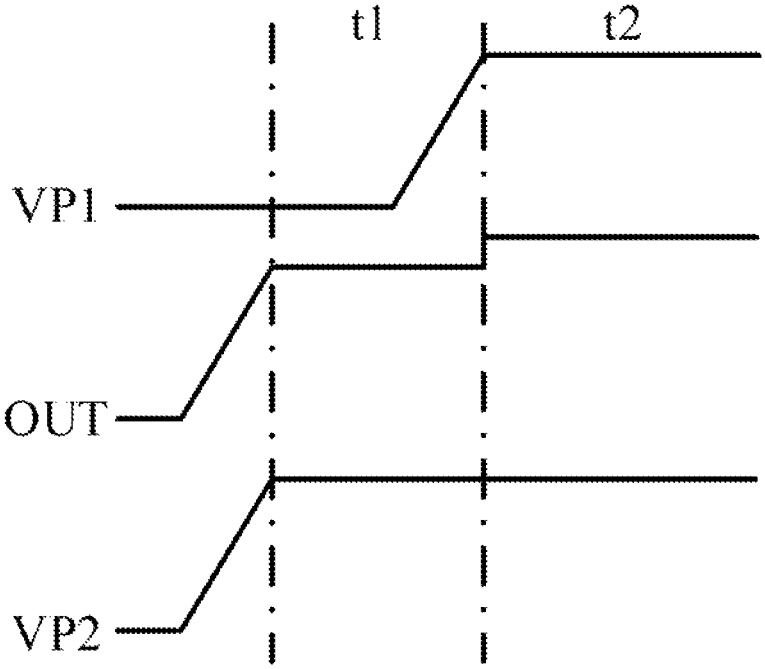
FIG. 6 is a timing diagram of a voltage regulator corresponding to FIG. 4.

FIG. 6 is a timing diagram of a voltage regulator corresponding to FIG. 4. As shown in FIGS. 4, 5 and 6, by using an example in which the transistor T21 and the transistor T22 are both P-type transistors, in a time period t1, the voltage V1 of the first power supply VP1 is lower than the voltage V2 of the second power supply VP2. When the voltage detection circuit 10 of the voltage regulator 100 detects that the voltage V1 of the first power supply VP1 is lower than the voltage V2 of the second power supply VP2, the voltage detection circuit 10 outputs the first control signal con1 and the second control signal con2 to the voltage regulation circuit 20 and the loop current prevention circuit 30. Under the control of the first control signal con1 and the second control signal con2, the voltage regulation circuit 20 enables the higher voltage V2 of the second power supply VP2 to be outputted to the stable voltage output terminal OUT and outputted from the stable voltage output terminal OUT to the load circuit 200. Meanwhile, under the control of the first control signal con1 and the second control signal con2, the loop current prevention circuit 30 prevents the loop from being formed between the first power supply VP1 and the stable voltage output terminal OUT, thereby preventing the lower voltage of the first power supply VP1 from being outputted to the stable voltage output terminal OUT. Thus, in the time period t1, when the clock pulse signal CK1 received by the gate of the P-type transistor M1 and the gate of the N-type transistor in the inverter structure 210 of the load circuit 200 is a low-level signal, the P-type transistor M1 is turned on and the voltage V2 of the second power supply VP2 outputted from the stable voltage output terminal OUT of the voltage regulator 100 is outputted to the gate of the transistor T21 through the P-type transistor that is turned on. In this case, a difference between the voltage V2 of the second power supply VP2 received by the gate of the transistor T21 and the voltage V2 of the second power supply VP2 received by the first electrode of the transistor T21 is 0 and greater than a threshold voltage of the P-type transistor T21 so that the transistor T21 cannot be turned on and the second power supply VP2 cannot pass through the transistor T21. Correspondingly, when the clock pulse signal CK1 is the low-level signal, the P-type transistor T22 is turned on so that the voltage of the third power supply VP3 is outputted to the output OUT' of the load circuit 200 through the transistor T22 that is turned on.

In a time period t2, the voltage V1 of the first power supply VP1 is higher than the voltage V2 of the second power supply VP2. When the voltage detection circuit 10 of the voltage regulator 100 detects that the voltage V1 of the first power supply VP1 is higher than the voltage of the second power supply VP2, the voltage detection circuit 10 outputs the third control signal con3 and the fourth control signal con4 to the voltage regulation circuit 20 and the loop current prevention circuit 30. Under the control of the third control signal con3 and the fourth control signal con4, the voltage regulation circuit 20 can prevent the lower voltage V2 of the second power supply VP2 from being outputted to the stable voltage output terminal OUT. Meanwhile, under the control of the third control signal con3 and the fourth control signal con4, the loop current prevention circuit 30 can enable a loop to be formed between the error amplification circuit 40 and the stable voltage output terminal OUT so that the error amplification circuit 40 outputs the error amplification signal VG to the stable voltage output terminal OUT and the error amplification signal VG is outputted from the stable voltage output terminal OUT to the load circuit 200. Since the voltage Vg of the error amplification signal VG is higher than the voltage V2 of the second power supply VP2, when the clock pulse signal CK1 received by the gate of the P-type transistor M1 and the gate of the N-type transistor M2 in the inverter structure 210 of the load circuit 200 is the low-level signal in the time period t2, the P-type transistor M1 is turned on and the voltage Vg of the error amplification signal VG outputted from the stable voltage output terminal OUT of the voltage regulator 100 is outputted to the gate of the transistor T21 through the P-type transistor that is turned on. In this case, a difference between the voltage Vg of the error amplification signal VG received by the gate of the transistor T21 and the voltage V2 of the second power supply VP2 received by the first electrode of the transistor T21 is greater than 0 and greater than the threshold voltage of the P-type transistor T21 so that the transistor T21 cannot be turned on and the second power supply VP2 cannot pass through the transistor T21. Correspondingly, when the clock pulse signal CK1 is the low-level signal, the P-type transistor T22 is turned on so that the third power supply VP3 is outputted to the output OUT' of the load circuit 200 through the transistor T22 that is turned on.

It is to be understood that in the time periods t1 and t2, when a clock pulse signal CK1 is at a high level, the transistor T22 is not turned on and the N-type transistor M2 in the inverter structure 210 is turned on so that a ground signal GND is outputted to the gate of the transistor T21 through the N-type transistor M2 that is turned on. In this case, a difference between the ground signal at the gate of the transistor T21 and the second power supply VP2 at the first electrode of the transistor T21 is smaller than the threshold voltage of the transistor T21 so that the transistor T21 is turned on and the second power supply VP2 can be controlled to be outputted to the output OUT' of the load circuit 200 through the transistor T21 that is turned on.

Therefore, when the voltage V1 of the first power supply VP1 is lower than the voltage V2 of the second power supply VP2 or when the voltage V1 of the first power supply VP1 is higher than the voltage V2 of the second power supply VP2, neither of the voltages outputted from the stable voltage output terminal OUT of the voltage regulator 100 will enable the transistor T21 and the transistor T22 of the load circuit 200 to be turned on at the same time, so as to avoid the misoperation of the load circuit 200 due to the small voltage outputted from the stable voltage output terminal OUT of the voltage regulator 100. Thus, the voltage regulator 100 has relatively high operation stability and reliability, thereby ensuring the operation stability of the load circuit 200 electrically connected to the voltage regulator 100.

It is to be noted that the load circuit shown in FIG. 5 is merely an exemplary load circuit in the embodiments of the present disclosure, and the voltages outputted from the stable voltage output terminal of the voltage regulator provided by the embodiments of the present disclosure may also be supplied to other load circuits to ensure the stable operation of the corresponding load circuits. The structure of the load circuit electrically connected to the voltage regulator is not specifically limited in the embodiments of the present disclosure. Additionally, the structures of the voltage detection circuit, the voltage regulation circuit, the loop current prevention circuit, and the error amplification circuit of the voltage regulator are not specifically limited in the embodiments of the present disclosure on the premise that the core inventive points of the embodiments of the present disclosure are met. The structures of various circuits in the voltage regulator provided by the embodiments of the present disclosure are described by way of examples with reference to the drawings.

Figure 7:
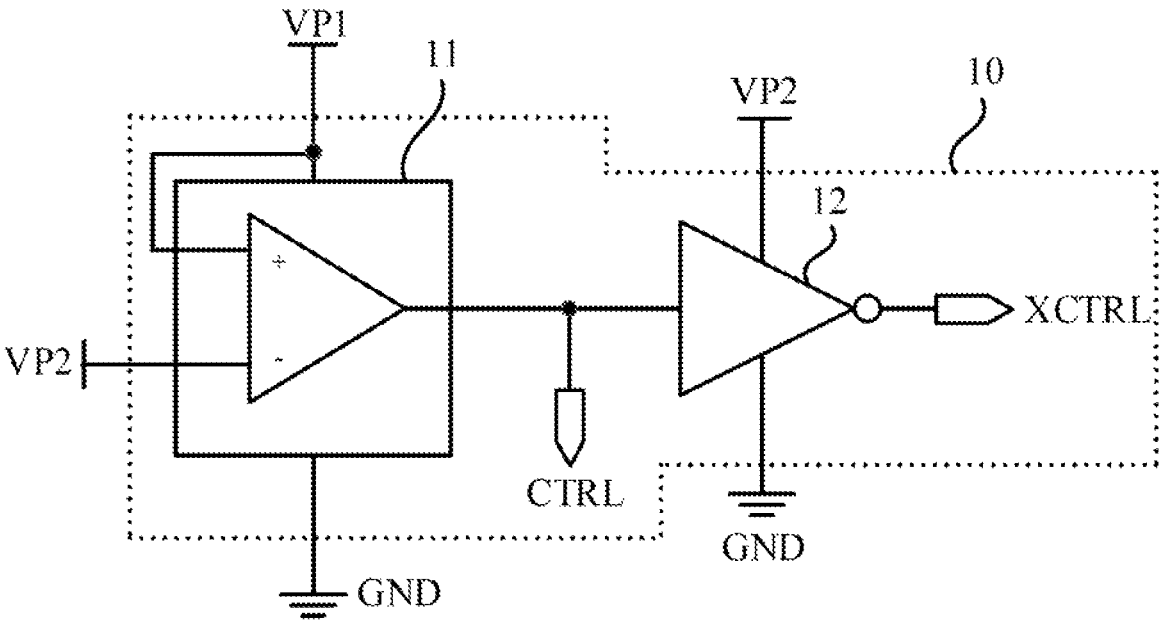
FIG. 7 is a structure diagram of another voltage detection circuit according to embodiments of the present disclosure.

Optionally, FIG. 7 is a structure diagram of another voltage detection circuit according to embodiments of the present disclosure. As shown in FIG. 7, the voltage detection circuit 10 includes a comparator unit 11 and an inverter 12. A first input terminal of the comparator unit 11 is electrically connected to the first power supply VP1, a second input terminal of the comparator unit 11 is electrically connected to the second power supply VP2, and a first output terminal of the comparator unit 11 is electrically connected to an input terminal of the inverter 12. A first power terminal of the comparator unit 11 is electrically connected to the first power supply VP1 and a second power terminal of the comparator unit 11 is grounded. The comparator unit 11 is configured to output the first control signal con1 to the inverter 12, the loop current prevention circuit 30, and the voltage regulation circuit 20 when the voltage of the first power supply VP1 is lower than the voltage of the second power supply VP2 and output the third control signal con3 to the inverter 12, the loop current prevention circuit 30, and the voltage regulation circuit 20 when the first power supply VP1 is higher than the second power supply VP2. A high-level signal terminal of the inverter 12 is electrically connected to the second power supply VP2 and a low-level signal terminal of the inverter 12 is grounded. The inverter 12 is configured to output the second control signal con2 to the loop current prevention circuit 30 and the voltage regulation circuit 20 when receiving the first control signal con1 and output the fourth control signal con4 to the loop current prevention circuit 30 and the voltage regulation circuit 20 when receiving the third control signal con3. The first control signal con1 and the fourth control signal con4 are low-level signals, the second control signal con2 is a voltage signal of the second power supply VP2, and the third control signal con3 is a voltage signal of the first power supply VP1.

Specifically, the comparator unit 11 may include, for example, a comparator and a peripheral circuit electrically connected to the comparator. The first power supply VP1 may be electrically connected to a non-inverting input terminal of the comparator in the comparator unit 11 and the second power supply VP2 may be electrically connected to an inverting input terminal of the comparator in the comparator unit 11. When the voltage of the first power supply VP1 electrically connected to the non-inverting input terminal of the comparator is lower than the voltage of the second power supply VP2 electrically connected to the inverting input terminal of the comparator, the comparator outputs a low-level signal, that is, the first control signal con1 that is the low-level signal. In this case, the low-level first control signal con1 outputted from the comparator is inputted to the inverter 12 so that the inverter 12 outputs the second power supply VP2 at the high-level signal terminal thereof, that is, outputs the high-level second control signal con2. When the voltage of the first power supply VP1 electrically connected to the non-inverting input terminal of the comparator is higher than the voltage of the second power supply VP2 electrically connected to the inverting input terminal of the comparator, the comparator outputs the high-level voltage signal of the first power supply VP1, that is, the high-level third control signal con3. In this case, the high-level third control signal con3 outputted from the comparator is inputted to the inverter 12 so that the inverter 12 outputs the ground signal GND at the low-level signal terminal thereof, that is, the low-level fourth control signal con4. The first control signal con1 or the third control signal con3 is outputted from a first output terminal CTRL of the voltage detection circuit 10, and the second control signal con2 or the fourth control signal con4 is outputted from a second output terminal XCTRL of the voltage detection circuit 10.

Figure 8:
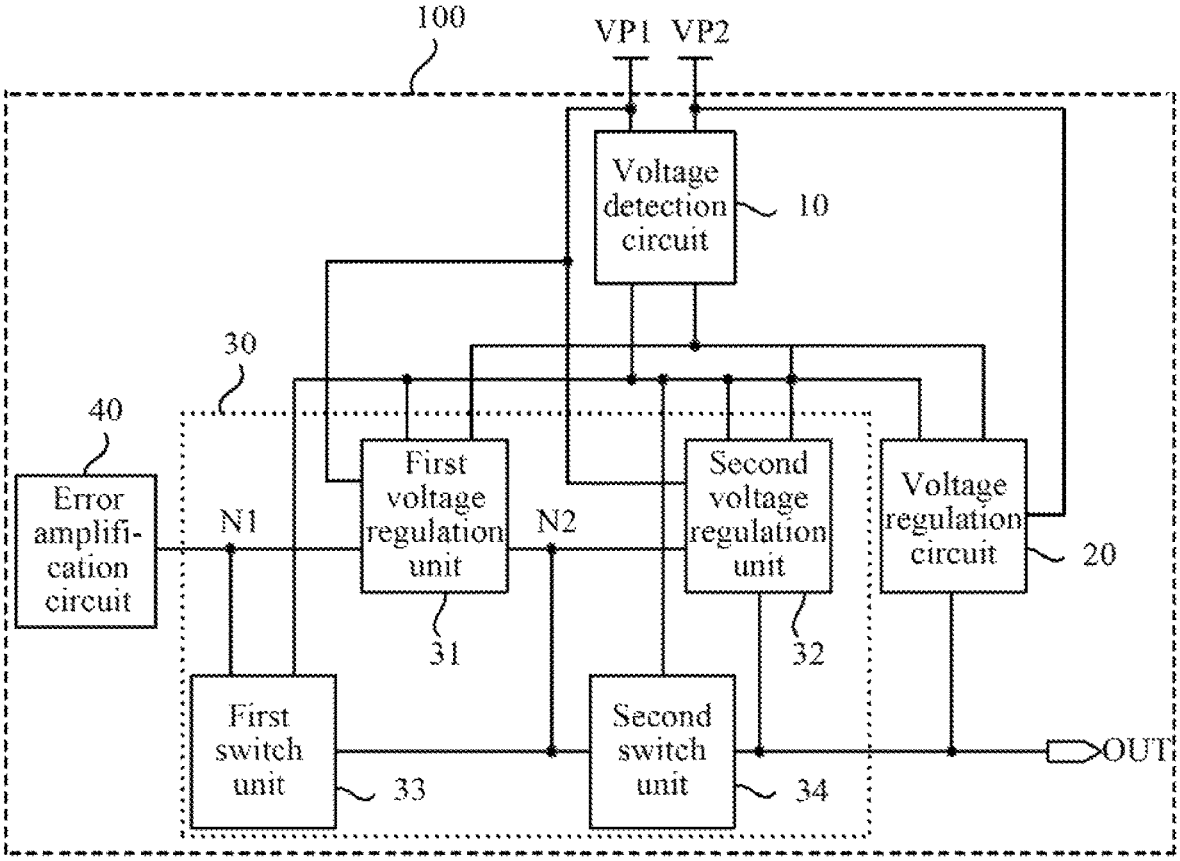
FIG. 8 is a structure diagram of another voltage regulator according to embodiments of the present disclosure.

Optionally, FIG. 8 is a structure diagram of another voltage regulator according to embodiments of the present disclosure. As shown in FIG. 8, the loop current prevention circuit 30 may include a first voltage regulation unit 31, a second voltage regulation unit 32, a first switch unit 33, and a second switch unit 34. The first voltage regulation unit 31 is electrically connected to the error amplification circuit 40, the first power supply VP1, the second voltage regulation unit 32, and the voltage detection circuit 10, separately, where the first voltage regulation unit 31 is electrically connected to the error amplification circuit 40 through a first node N1 and electrically connected to the second voltage regulation unit 32 through a second node N2. The first voltage regulation unit 31 is configured to prevent a voltage at the first node N1 and the voltage signal of the first power supply VP1 from being transmitted to the second node N2 when receiving the first control signal con1 and the second control signal con2 and control the voltage at the first node N1 to be transmitted to the second node N2 and prevent the voltage signal of the first power supply VP1 from being transmitted to the second node N2 when receiving the third control signal con3 and the fourth control signal con4. The first switch unit 33 is electrically connected to the voltage detection circuit 10, the first node N1, and the second node N2, separately. The first switch unit 33 is configured to receive the first control signal con1 or the third control signal con3, turn off when receiving the first control signal con1 to prevent the voltage at the first node N1 from being transmitted to the second node N2, and turn on when receiving the third control signal con3 to enable the voltage at the first node N1 to be transmitted to the second node N2. The second switch unit 34 is electrically connected to the voltage detection circuit 10, the second node N2, and the stable voltage output terminal OUT, separately. The second switch unit 34 is configured to receive the first control signal con1 or the third control signal con3, connect the second node N2 to the stable voltage output terminal OUT when receiving the first control signal con1, and disconnect the second node N2 from the stable voltage output terminal OUT when receiving the third control signal con3. The second voltage regulation unit 32 is electrically connected to the voltage detection circuit 10, the first power supply VP1, the second node N2, and the stable voltage output terminal OUT. The second voltage regulation unit 32 is configured to prevent the voltage signal of the first power supply VP1 from being transmitted to the stable voltage output terminal OUT when receiving the first control signal con1 and the second control signal con2 and adjust a signal of the stable voltage output terminal OUT to the error amplification signal when receiving the third control signal con3 and the fourth control signal con4.

Specifically, when the voltage of the first power supply VP1 is lower than the voltage of the second power supply VP2, the voltage detection circuit 10 outputs the first control signal con1 and the second control signal con2, inputs the first control signal con1 to the first voltage regulation unit 31, the second voltage regulation unit 32, the first switch unit 33, and the second switch unit 34 in the loop current prevention circuit 30, and inputs the second control signal con2 to the first voltage regulation unit 31 and the second voltage regulation unit 32 in the loop current prevention circuit 30, so that the first voltage regulation unit 31 prevents the voltage at the first node N1 and the voltage signal of the first power supply VP1 from being transmitted to the second node N2 under the control of the first control signal con1 and the second control signal con2, and the second voltage regulation unit 32 can prevent the voltage signal of the first power supply VP1 from being transmitted to the stable voltage output terminal OUT under the control of the first control signal con1, the second control signal con2, and a voltage at the second node N2, so as to prevent a first power signal VP1 with a lower voltage from being outputted from the stable voltage output terminal OUT to the corresponding load circuit and ensure the normal operation of the load circuit. Meanwhile, the first switch unit 33 is turned off when receiving the first control signal con1 and the second switch unit 34 is turned on when receiving the first control signal con1 so that the voltage at the first node N1 cannot be transmitted to the stable voltage output terminal OUT and the signal of the first power supply VP1 cannot be reversed to the first node N1.

When the voltage of the first power supply VP1 is higher than the voltage of the second power supply VP2, the voltage detection circuit 10 outputs the third control signal con3 and the fourth control signal con4, inputs the third control signal con3 to the first voltage regulation unit 31, the second voltage regulation unit 32, the first switch unit 33, and the second switch unit 34 in the loop current prevention circuit 30, and inputs the fourth control signal con4 to the first voltage regulation unit 31 and the second voltage regulation unit 32 in the loop current prevention circuit 30, so that the first voltage regulation unit 31 enables the voltage at the first node N1 to be transmitted to the second node N2 under the control of the third control signal con3 and the fourth control signal con4 and the second voltage regulation unit 32 can adjust the signal of the stable voltage output terminal OUT to the error amplification signal VG under the control of the third control signal con3, the fourth control signal con4, and the voltage at the second node N2, where the voltage of the error amplification signal VG is higher than the voltage of the second power supply VP2, so as to prevent a reverse current from the second power supply VP2 to the output terminal of the error amplification signal VG and ensure the normal operation of the load circuit electrically connected to the stable voltage output terminal OUT. Meanwhile, the first switch unit 33 is turned on when receiving the third control signal con3 and the second switch unit 34 is turned off when receiving the third control signal con3, that is, the voltage at the first node N1 can be transmitted to the second node N2 through the first switch unit 33, but the voltage at the second node N2 cannot be transmitted to the stable voltage output terminal OUT through the second switch unit 34.

Figure 9:
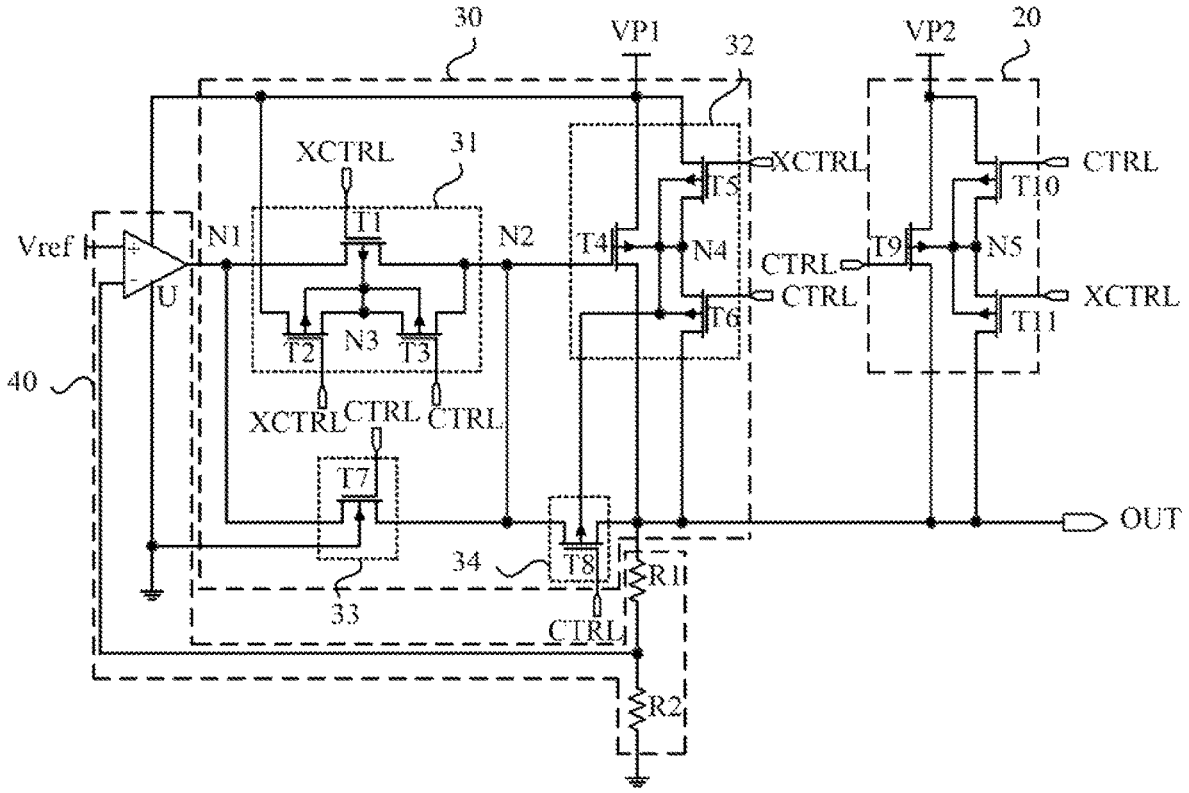
FIG. 9 is a structure diagram of specific circuits in a voltage regulator according to embodiments of the present disclosure.

Optionally, FIG. 9 is a structure diagram of specific circuits in a voltage regulator according to embodiments of the present disclosure. As shown in FIGS. 8 and 9, the first voltage regulation unit 31 in the loop current prevention circuit 30 may include a first metal-oxide-semiconductor (MOS) transistor T1, a second MOS transistor T2, and a third MOS transistor T3. A gate of the first MOS transistor T1 is electrically connected to the voltage detection circuit 10 and receives the second control signal con2 or the fourth control signal con4, a first electrode of the first MOS transistor T1 is electrically connected to the first node N1, and a second electrode of the first MOS transistor T1 is electrically connected to the second node N2. A gate of the second MOS transistor T2 is electrically connected to the voltage detection circuit 10 and receives the second control signal con2 or the fourth control signal con4, a first electrode of the second MOS transistor T2 is electrically connected to the first power supply VP1, and a second electrode of the second MOS transistor T2 is electrically connected to a first electrode of the third MOS transistor T3 through a third node N3. A gate of the third MOS transistor T3 is electrically connected to the voltage detection circuit 10 and receives the first control signal con1 or the third control signal con3 and a second electrode of the third MOS transistor T3 is electrically connected to the second node. A substrate of the first MOS transistor T1, a substrate of the second MOS transistor T2, and a substrate of the third MOS transistor T3 are electrically connected to the third node N3.

It is to be noted that FIG. 9 is merely an exemplary description of the embodiments of the present disclosure and the first MOS transistor T1, the second MOS transistor T2, and the third MOS transistor T3 in the first voltage regulation unit 31 in FIG. 9 are all P-channel MOS transistors. In the embodiments of the present disclosure, the first MOS transistor T1, the second MOS transistor T2, and the third MOS transistor T3 in the first voltage regulation unit may also be N-channel MOS transistors, which is not specifically limited in the embodiments of the present disclosure. Meanwhile, the types of MOS transistors in other circuits of the voltage regulator provided by the embodiments of the present disclosure are not specifically limited. The N-channel MOS transistor is turned on when a voltage difference between a gate and a source of the N-channel MOS transistor is higher than a threshold voltage of the N-channel MOS transistor, and the P-channel MOS transistor is turned on when a voltage difference between a gate and a source of the P-channel MOS transistor is lower than a threshold voltage of the P-channel MOS transistor.

Exemplarily, as shown in FIGS. 7 and 9, the first MOS transistor T1, the second MOS transistor T2, and the third MOS transistor T3 are all P-channel field-effect transistors. The first output terminal CTRL of the voltage detection circuit 10 outputs the first control signal con1 or the third control signal con3 and the second output terminal XCTRL of the voltage detection circuit 10 outputs the second control signal con2 or the fourth control signal con4. The gate of the first MOS transistor T1 and the gate of the second MOS transistor T2 are electrically connected to the second output terminal XCTRL of the voltage detection circuit 10, and the gate of the third MOS transistor T3 is electrically connected to the first output terminal CTRL of the voltage detection circuit 10. Since the first control signal con1 and the fourth control signal con4 are the low-level signals, the second control signal con2 is the high-level voltage signal of the second power supply VP2, and the third control signal con3 is the high-level voltage signal of the first power supply VP1.

When the voltage of the first power supply VP1 is lower than the voltage of the second power supply VP2, the first output terminal CTRL of the voltage detection circuit 10 outputs the low-level first control signal con1 and the second output terminal XCTRL of the voltage detection circuit 10 outputs the high-level second control signal con2. In this case, the third MOS transistor T3 is turned on and a voltage at the third node N3 is the same as the voltage at the second node N2 so that a substrate voltage Vb1 of the first MOS transistor T1 and a substrate voltage Vb2 of the second MOS transistor T2 are equal to the voltage at the second node N2. Since the second switch unit 34 is turned on, the voltage at the second node N2 is the same as a voltage of the stable voltage output terminal OUT, that is, the voltage at the third node N3 is equal to the voltage of the second power supply VP2. The second control signal con2 received by the gate of the first MOS transistor T1 and the gate of the second MOS transistor T2 is equal to the voltage signal of the second power supply VP2 so that the first MOS transistor T1 and the second MOS transistor T2 are turned off and the voltage at the first node N1 and the voltage of the first power supply VP1 cannot be transmitted to the second node N2.

When the voltage of the first power supply VP1 is higher than the voltage of the second power supply VP2, the first output terminal CTRL of the voltage detection circuit 10 outputs the high-level third control signal con3 and the second output terminal XCTRL of the voltage detection circuit 10 outputs the low-level fourth control signal con4. In this case, the second MOS transistor T2 is turned on and the first power supply VP1 is transmitted to the third node N3 through the second MOS transistor T2 that is turned on so that the voltage at the third node N3 is equal to the voltage of the first power supply VP1. That is, the substrate voltage Vb1 of the first MOS transistor T1 is equal to the voltage of the first power supply VP1 so that the first MOS transistor T1 can be turned on under the control of the fourth control signal con4 and the voltage at the first node N1 is equal to the voltage at the second node N2. Correspondingly, the first switch unit 33 is turned on and the second switch unit 34 is turned off so that a loop can be formed from the first node N1 to the second node N2, but the voltage at the first node N1 or the voltage at the second node N2 cannot be directly transmitted to the stable voltage output terminal OUT. In this manner, the stable voltage output terminal OUT outputs the error amplification signal with the higher voltage.

Optionally, the first switch unit 33 may include a seventh MOS transistor T7 and the second switch unit 34 may include an eighth MOS transistor T8. A gate of the seventh MOS transistor T7 is electrically connected to the voltage detection circuit 10 and receives the first control signal con1 or the third control signal con3, a first electrode of the seventh MOS transistor T7 is electrically connected to the first node N1, and a second electrode of the seventh MOS transistor T7 is electrically connected to the second node N2. A gate of the eighth MOS transistor T8 is electrically connected to the voltage detection circuit 10 and receives the first control signal con1 or the third control signal con3, a first electrode of the eighth MOS transistor T8 is electrically connected to the second node N2, and a second electrode of the eighth MOS transistor T8 is electrically connected to the stable voltage output terminal OUT. The seventh MOS transistor T7 and the eighth MOS transistor T8 have different channel types. For example, the seventh MOS transistor may be an N-channel field-effect transistor and the eighth MOS transistor T8 may be the P-channel field-effect transistor.

Additionally, the seventh MOS transistor and the eighth MOS transistor may have the same channel type. In this case, if the gate of the seventh MOS transistor receives the second control signal con2 or the fourth control signal con4, the gate of the eighth MOS transistor receives the first control signal con1 or the third control signal con3. Alternatively, if the gate of the seventh MOS transistor receives the first control signal con1 or the third control signal con3, the gate of the eighth MOS transistor receives the second control signal con2 or the fourth control signal con4. This is not limited in the embodiments of the present disclosure.

Optionally, with continued reference to FIGS. 8 and 9, the second voltage regulation unit 32 in the loop current prevention circuit 30 includes a fourth MOS transistor T4, a fifth MOS transistor T5, and a sixth MOS transistor T6. A gate of the fourth MOS transistor T4 is electrically connected to the second node N2, a first electrode of the fourth MOS transistor T4 is electrically connected to the first power supply VP1, and a second electrode of the fourth MOS transistor T4 is electrically connected to the stable voltage output terminal OUT. A gate of the fifth MOS transistor T5 is electrically connected to the voltage detection circuit 10 and receives the second control signal con2 or the fourth control signal con4, a first electrode of the fifth MOS transistor T5 is electrically connected to the first power supply VP1, and a second electrode of the fifth MOS transistor T5 is electrically connected to a first electrode of the sixth MOS transistor T6 through a fourth node N4. A gate of the sixth MOS transistor T6 is electrically connected to the voltage detection circuit 10 and receives the first control signal con1 or the third control signal con3 and a second electrode of the sixth MOS transistor T6 is electrically connected to the stable voltage output terminal OUT. A substrate of the fourth MOS transistor T4, a substrate of the fifth MOS transistor T5, and a substrate of the sixth MOS transistor T6 are electrically connected to the fourth node N4.

Exemplarily, as shown in FIGS. 7 and 9, the fourth MOS transistor T4, the fifth MOS transistor T5, and the sixth MOS transistor T6 are all the P-channel field-effect transistors. When the voltage of the first power supply VP1 is lower than the voltage of the second power supply VP2, the first output terminal CTRL of the voltage detection circuit 10 outputs the low-level first control signal con1 and the second output terminal XCTRL of the voltage detection circuit 10 outputs the high-level second control signal con2 which is the voltage signal of the second power supply VP2. In this case, the sixth MOS transistor T6 is turned on and a voltage at the fourth node N4 is equal to the voltage of the stable voltage output terminal OUT. Meanwhile, the second switch unit 34 is turned on so that the voltage at the second node N2 is equal to the voltage of the stable voltage output terminal OUT, that is, the voltage at the second node N2 is the high-level voltage of the second power supply VP2. The gate of the fourth MOS transistor T4 receives the high-level signal and the gate of the fifth MOS transistor T5 also receives the high-level signal so that neither the fourth MOS transistor T4 nor the fifth MOS transistor T5 can be turned on and the first power supply VP1 cannot be conducted with the stable voltage output terminal OUT, that is, the first power supply VP1 cannot be outputted from the stable voltage output terminal OUT.

When the voltage of the first power supply VP1 is higher than the voltage of the second power supply VP2, the first output terminal CTRL of the voltage detection circuit 10 outputs the high-level third control signal con3 which is the voltage signal of the first power supply VP1, and the second output terminal XCTRL of the voltage detection circuit 10 outputs the low-level fourth control signal con4. In this case, the fifth MOS transistor T5 is turned on and the voltage at the fourth node N4 is equal to the voltage of the first power supply VP1, and the voltage at the second node N2 is equal to the voltage at the first node N1 since the first switch unit 33 is turned on. Since the first node N1 is electrically connected to the error amplification circuit 40, the first node N1 receives an error signal outputted from the error amplification circuit 40 and the error signal cannot control the fourth MOS transistor to turn on so that the first power supply VP1 still cannot be transmitted to the stable voltage output terminal OUT, but the error amplification signal VG outputted from the error amplification circuit 40 can be transmitted to the stable voltage output terminal OUT and outputted from the stable voltage output terminal OUT to the corresponding load circuit.

Optionally, with continued reference to FIGS. 8 and 9, the voltage regulation circuit 20 includes a ninth MOS transistor T9, a tenth MOS transistor T10, and an eleventh MOS transistor T11. Agate of the ninth MOS transistor T9 is electrically connected to the voltage detection circuit 10 and receives the first control signal con1 or the third control signal con3, a first electrode of the ninth MOS transistor T9 is electrically connected to the second power supply VP2, and a second electrode of the ninth MOS transistor T9 is electrically connected to the stable voltage output terminal OUT. A gate of the tenth MOS transistor T10 is electrically connected to the voltage detection circuit 10 and receives the first control signal con1 or the third control signal con3, a first electrode of the tenth MOS transistor T10 is electrically connected to the second power supply VP2, and a second electrode of the tenth MOS transistor T10 is electrically connected to a first electrode of the eleventh MOS transistor T11 through a fifth node N5. A gate of the eleventh MOS transistor T11 is electrically connected to the voltage detection circuit 10 and receives the second control signal con2 or the fourth control signal con4 and a second electrode of the eleventh MOS transistor T11 is electrically connected to the stable voltage output terminal OUT. A substrate of the ninth MOS transistor T9, a substrate of the tenth MOS transistor T10, and a substrate of the eleventh MOS transistor T11 are electrically connected to the fifth node N5.

Exemplarily, as shown in FIGS. 7 and 9, the ninth MOS transistor T9, the tenth MOS transistor T10, and the eleventh MOS transistor T11 are all the P-channel field-effect transistors. When the voltage of the first power supply VP1 is lower than the voltage of the second power supply VP2, the first output terminal CTRL of the voltage detection circuit 10 outputs the low-level first control signal con1 and the second output terminal XCTRL of the voltage detection circuit 10 outputs the high-level second control signal con2 which is the voltage signal of the second power supply VP2. In this case, the tenth MOS transistor T10 is turned on so that a voltage at the fifth node N5 is equal to the voltage of the second power supply VP2, the ninth MOS transistor T9 is turned on, and the second power supply VP2 is transmitted to the stable voltage output terminal OUT through the ninth MOS transistor T9 that is turned on so that the stable voltage output terminal OUT outputs the high-level voltage signal of the second power supply VP2.

When the voltage of the first power supply VP1 is higher than the voltage of the second power supply VP2, the first output terminal CTRL of the voltage detection circuit 10 outputs the high-level third control signal con3 which is the voltage signal of the first power supply VP1, and the second output terminal XCTRL of the voltage detection circuit 10 outputs the low-level fourth control signal con4. In this case, the eleventh MOS transistor T11 is turned on so that the voltage at the fifth node N5 is equal to the voltage of the stable voltage output terminal OUT. That is, the voltage at the fifth node N5 is the voltage of the error amplification signal VG so that neither the ninth MOS transistor T9 nor the tenth MOS transistor T10 can be turned on, the second power supply VP2 cannot be conducted with the stable voltage output terminal OUT, and the signal of the stable voltage output terminal OUT is not reversed to the second power supply VP2.

Optionally, with continued reference to FIG. 9, the error amplification circuit 40 may include an error amplifier U, a first resistor R1, and a second resistor R2. A first power terminal of the error amplifier U is electrically connected to the first power supply VP1, a second power terminal of the error amplifier U is grounded, an output terminal of the error amplifier U is electrically connected to the stable voltage output terminal OUT through the loop current prevention circuit 30, a non-inverting input terminal of the error amplifier U is electrically connected to a reference power supply Vref, and an inverting input terminal of the error amplifier U is electrically connected to the stable voltage output terminal OUT through the first resistor R1 and grounded through the second resistor R2.

Here, when the voltage of the first power supply VP1 is higher than the voltage of the second power supply VP2, the first power supply VP1 serves as the power supply for the error amplifier U so that the error amplifier U operates normally. In this case, the voltage Vg of the error amplification signal VG outputted from the stable voltage output terminal is as follows:

$$Vg=(V\text{ref}/R1)*(R11+R21)>V2$$

where R11 denotes the resistance of the first resistor R1, R21 denotes the resistance of the second resistor R2, and V2 denotes the voltage of the second power supply VP2.

Figure 10:
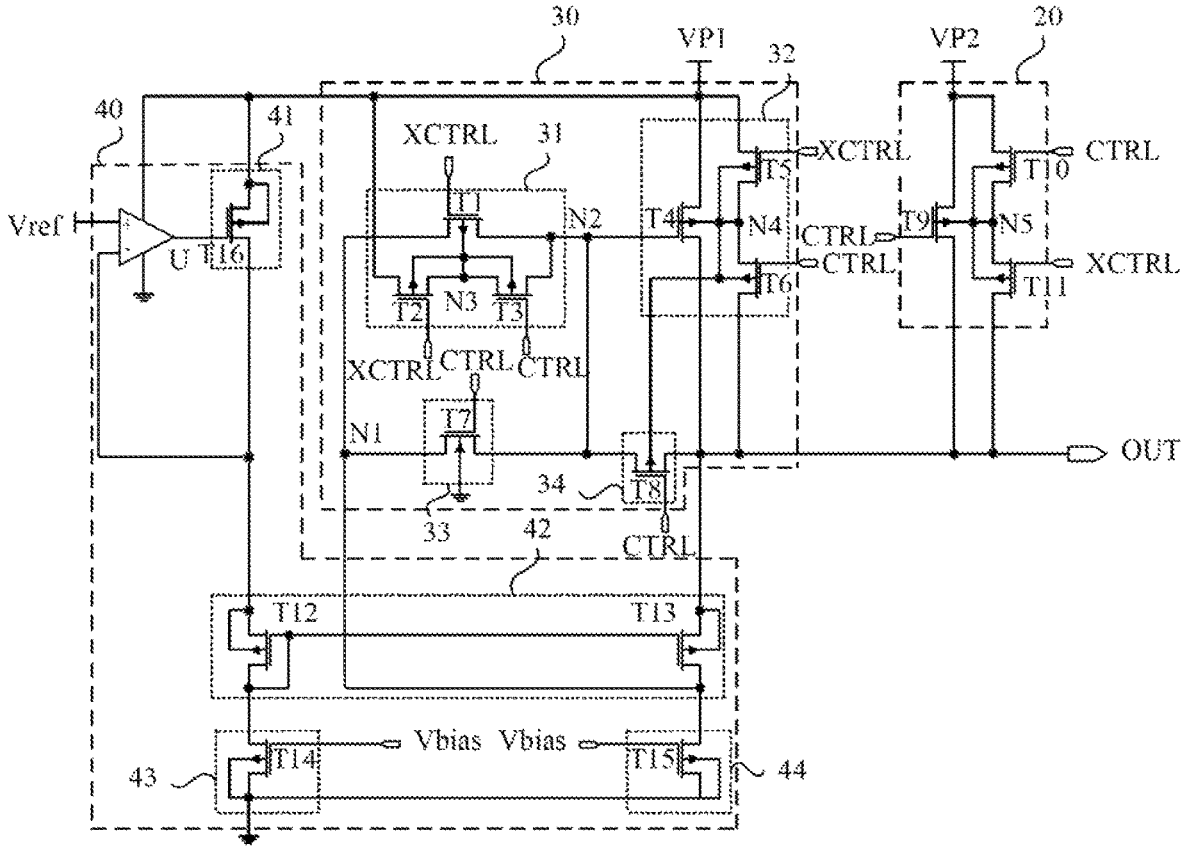
FIG. 10 is a structure diagram of specific circuits in another voltage regulator according to embodiments of the present disclosure.

Optionally, FIG. 10 is a structure diagram of specific circuits in another voltage regulator according to embodiments of the present disclosure. For the similarities between FIG. 10 and FIG. 9, reference may be made to the preceding description of FIG. 9 and details are not repeated here. Merely the differences between FIG. 10 and FIG. 9 are exemplarily described. As shown in FIG. 10, the error amplification circuit 40 includes an error amplifier U, a control unit 41, a current mirror unit 42, a first load unit 43, and a second load unit 44. A first power terminal of the error amplifier U is electrically connected to the first power supply VP1, a second power terminal of the error amplifier U is grounded, a non-inverting input terminal of the error amplifier U is electrically connected to a reference power supply Vref, and an inverting input terminal of the error amplifier U is electrically connected to an output terminal of the control unit 41. A control terminal of the control unit 41 is electrically connected to an output terminal of the error amplifier U and an input terminal of the control unit 41 is electrically connected to the first power supply VP1. The control unit 41 is configured to feed back the voltage signal of the first power supply VP1 to the inverting input terminal of the error amplifier U according to a signal outputted from the error amplifier U. The current mirror unit 42 includes a twelfth MOS transistor T12 and a thirteenth MOS transistor T13; where a gate of the twelfth MOS transistor T12 is electrically connected to a gate of the thirteenth MOS transistor T13, a first electrode of the twelfth MOS transistor T12 is electrically connected to the inverting input terminal of the error amplifier U, and a second electrode of the twelfth MOS transistor T12 is grounded through the first load unit 43 and electrically connected to the gate of the twelfth MOS transistor T12; and a first electrode of the thirteenth MOS transistor T13 is electrically connected to the stable voltage output terminal OUT and a second electrode of the thirteenth MOS transistor T13 is grounded through the second load unit 44 and electrically connected to the loop current prevention circuit 30.

Exemplarily, the first load unit 43 may include a fourteenth MOS transistor T14, the second load unit 44 may include a fifteenth MOS transistor T15, and the control unit 41 may include, for example, a sixteenth MOS transistor. A gate of the fourteenth MOS transistor T14 and a gate of the fifteenth MOS transistor T15 are electrically connected to a bias power supply Vbias. A first electrode of the fourteenth MOS transistor T14 is electrically connected to the second electrode of the twelfth MOS transistor T12 and a second electrode of the fourteenth MOS transistor T14 is grounded. A first electrode of the fifteenth MOS transistor T15 is electrically connected to the second electrode of the thirteenth MOS transistor T13 and a second electrode of the fifteenth MOS transistor T15 is grounded. A gate of the sixteenth MOS transistor T16 is electrically connected to the output terminal of the error amplifier U, a first electrode of the sixteenth MOS transistor T16 is electrically connected to the first power supply VP1, and a second electrode of the sixteenth MOS transistor T16 is electrically connected to the inverting input terminal of the error amplifier U.

In this case, when the voltage of the first power supply VP1 is higher than the voltage of the second power supply VP2, the error amplifier U operates normally and a voltage of the non-inverting input terminal of the error amplifier U is equal to a voltage of the inverting input terminal of the error amplifier U so that a voltage signal of the reference power supply Vref electrically connected to the inverting input terminal is transmitted to the first electrode of the twelfth MOS transistor T12 in the current mirror unit 42. Due to a mirror current effect, a voltage of the first electrode of the thirteenth MOS transistor T13 in the current mirror unit 42 is also a voltage of the reference power supply Vref. Thus, the stable voltage output terminal OUT outputs the voltage signal of the reference power supply Vref and the voltage of the reference power supply Vref is higher than the voltage of the second power supply VP2, so as to ensure that the stable voltage output terminal OUT outputs a high-level voltage signal. In this manner, the load circuit electrically connected to the stable voltage output terminal OUT can operate normally.

Based on the same inventive concept, the embodiments of the present disclosure further provide a silicon-based display panel. The silicon-based display panel includes a silicon-based substrate, a display unit, and a voltage regulator according to the embodiments of the present disclosure. The voltage regulator and the display unit are formed on the silicon-based substrate and the voltage regulator is configured to provide a stable voltage signal for the display unit.

In this manner, since the silicon-based display panel provided by the embodiments of the present disclosure includes the voltage regulator provided by the embodiments of the present disclosure, the silicon-based display panel has the same technical effects as the voltage regulator provided by the embodiments of the present disclosure. The similarities are not repeated below and may be understood with reference to the preceding description of the voltage regulator.

Figure 11:
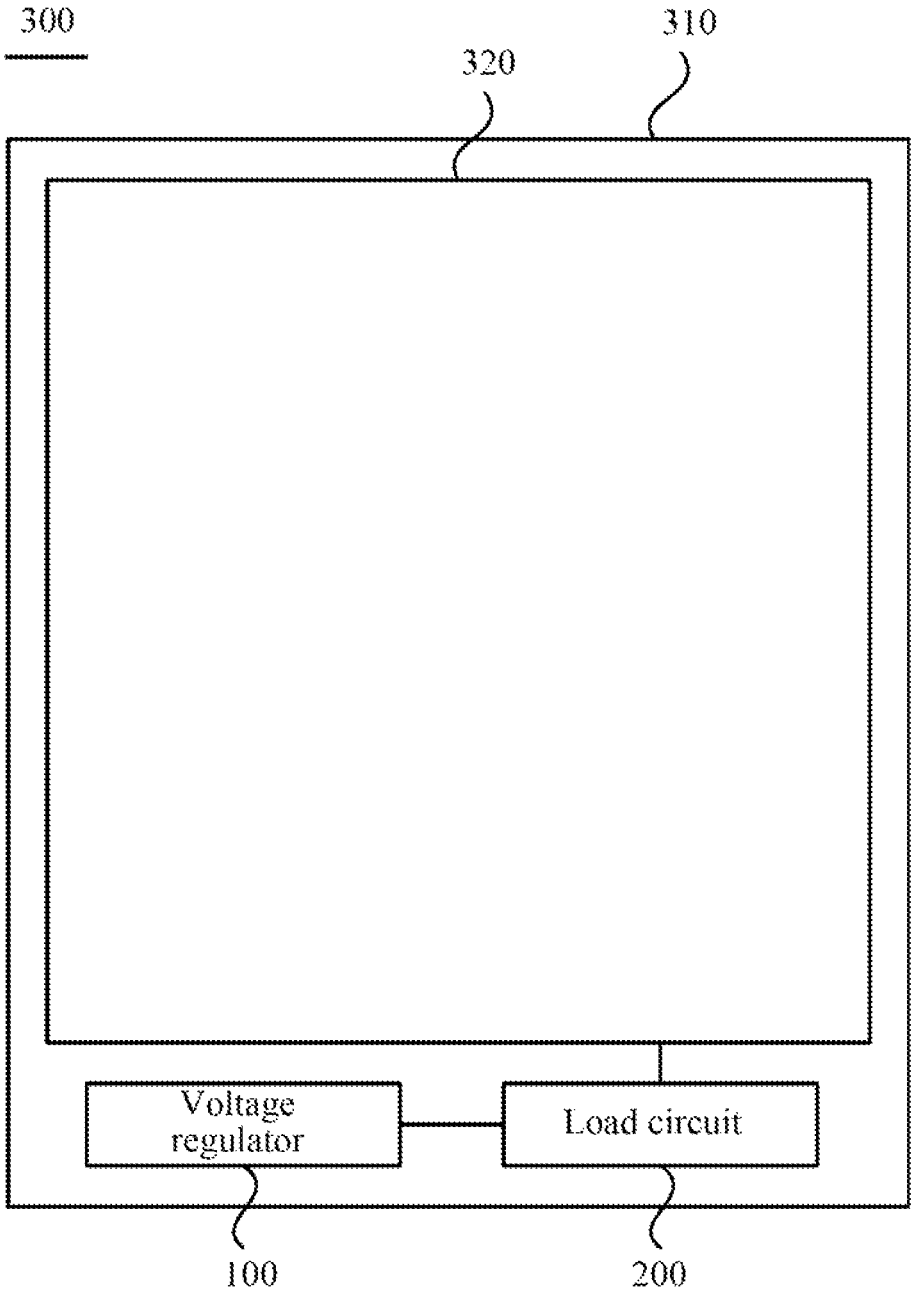
FIG. 11 is a structure diagram of a silicon-based display panel according to embodiments of the present disclosure.

Exemplarily, FIG. 11 is a structure diagram of a silicon-based display panel according to embodiments of the present disclosure. As shown in FIG. 11, the silicon-based display panel 300 includes the silicon-based substrate 310, the display unit 320, the voltage regulator 100, and the load circuit 200 electrically connected between the display unit 320 and the voltage regulator. The display unit 320 may include a plurality of pixels (not shown in the figure) arranged in an array, where each pixel in the display unit 320 can emit light for display under the control of the load circuit 200. The voltage regulator 100 can supply a power supply with a stable voltage to each pixel in the display unit 320 through the load circuit 200. Meanwhile, the voltage regulator 100, the load circuit 200, and the display unit 320 in the silicon-based display panel are all formed on a side of the silicon-based substrate, and various devices in the display panel may be formed on the silicon-based substrate using a CMOS technology. Since a device formed directly on the silicon-based substrate has the physical characteristics of a micro device, the silicon-based display panel can display a high-quality picture.

It is to be noted that the above are merely preferred embodiments of the present disclosure and the principles used therein. It will be understood by those skilled in the art that the present disclosure is not limited to the embodiments described herein. Those skilled in the art can make various apparent modifications, adaptations, combinations, and substitutions without departing from the scope of the present disclosure. Therefore, while the present disclosure has been described in detail through the above-mentioned embodiments, the present disclosure is not limited to the above-mentioned embodiments and may include more other equivalent embodiments without departing from the concept of the present disclosure. The scope of the present disclosure is determined by the scope of the appended claims.

What is claimed is:

1. A voltage regulator, comprising an error amplification circuit, a voltage detection circuit, a loop current prevention circuit, a voltage regulation circuit, and a stable voltage output terminal; wherein the voltage detection circuit is electrically connected to a first power supply, a second power supply, the loop current prevention circuit, and the voltage regulation circuit, separately; the voltage detection circuit is configured to output a first control signal and a second control signal to the loop current prevention circuit and the voltage regulation circuit when a voltage of the first power supply is lower than a voltage of the second power supply and output a third control signal and a fourth control signal to the loop current prevention circuit and the voltage regulation circuit when the voltage of the first power supply is higher than the voltage of the second power supply;

the voltage regulation circuit is further electrically connected between the second power supply and the stable voltage output terminal; the voltage regulation circuit is configured to output the voltage of the second power supply to the stable voltage output terminal when receiving the first control signal and the second control signal and stop outputting the voltage of the second power supply to the stable voltage output terminal when receiving the third control signal and the fourth control signal; and the loop current prevention circuit comprises a first voltage regulation circuit, a second voltage regulation circuit, a first switch circuit, and a second switch circuit; wherein the first voltage regulation circuit is electrically connected to the error amplification circuit, the first power supply, the second voltage regulation circuit, and the voltage detection circuit, separately, wherein the first voltage regulation circuit is electrically connected to the error amplification circuit through a first node and electrically connected to the second voltage regulation circuit through a second node; the first voltage regulation circuit is configured to prevent a voltage at the first node and a voltage signal of the first power supply from being transmitted to the second node when receiving the first control signal and the second control signal and control the voltage at the first node to be transmitted to the second node and prevent the voltage signal of the first power supply from being transmitted to the second node when receiving the third control signal and the fourth control signal;

the first switch circuit is electrically connected to the voltage detection circuit, the first node, and the second node, separately; the first switch circuit is configured to receive the first control signal or the third control signal turn off when receiving the first control signal to prevent the voltage at the first node from being transmitted to the second node, and turn on when receiving the third control signal to enable the voltage at the first node to be transmitted to the second node;

the second switch circuit is electrically connected to the voltage detection circuit the second node, and the stable voltage output terminal separately; the second switch circuit is configured to receive the first control signal or the third control signal connect the second node to the stable voltage output terminal when receiving the first control signal and disconnect the second node from the stable voltage output terminal when receiving the third control signal; and the second voltage regulation circuit is electrically connected to the voltage detection circuit the first power supply, the second node, and the stable voltage output terminal; the second voltage regulation circuit is configured to prevent the voltage signal of the first power supply from being transmitted to the stable voltage output terminal when receiving the first control signal and the second control signal and adjust a signal of the stable voltage output terminal to the error amplification signal when receiving the third control signal and the fourth control signal; and wherein a voltage of the error amplification signal is higher than the voltage of the second power supply.

2. The voltage regulator according to claim 1, wherein the voltage detection circuit comprises a comparator circuit and an inverter; wherein a first input terminal of the comparator circuit is electrically connected to the first power supply, a second input terminal of the comparator circuit is electrically connected to the second power supply, and a first output terminal of the comparator circuit is electrically connected to an input terminal of the inverter; a first power terminal of the comparator circuit is electrically connected to the first power supply and a second power terminal of the comparator circuit is grounded; the comparator circuit is configured to output the first control signal to the inverter, the loop current prevention circuit, and the voltage regulation circuit when the voltage of the first power supply is lower than the voltage of the second power supply and output the third control signal to the inverter, the loop current prevention circuit, and the voltage regulation circuit when the first power supply is higher than the second power supply;

a high-level signal terminal of the inverter is electrically connected to the second power supply and a low-level signal terminal of the inverter is grounded; and the inverter is configured to output the second control signal to the loop current prevention circuit and the voltage regulation circuit when receiving the first control signal and output the fourth control signal to the loop current prevention circuit and the voltage regulation circuit when receiving the third control signal;

wherein the first control signal and the fourth control signal are low-level signals, the second control signal is a voltage signal of the second power supply, and the third control signal is a voltage signal of the first power supply.

3. The voltage regulator according to claim 1, wherein the first voltage regulation circuit comprises a first metal-oxide-semiconductor (MOS) transistor, a second MOS transistor, and a third MOS transistor; wherein a gate of the first MOS transistor is electrically connected to the voltage detection circuit and is configured to receive the second control signal or the fourth control signal, a first electrode of the first MOS transistor is electrically connected to the first node, and a second electrode of the first MOS transistor is electrically connected to the second node;

a gate of the second MOS transistor is electrically connected to the voltage detection circuit and is configured to receive the second control signal or the fourth control signal, a first electrode of the second MOS transistor is electrically connected to the first power supply, and a second electrode of the second MOS transistor is electrically connected to a first electrode of the third MOS transistor through a third node;

a gate of the third MOS transistor is electrically connected to the voltage detection circuit and is configured to receive the first control signal or the third control signal and a second electrode of the third MOS transistor is electrically connected to the second node; and a substrate of the first MOS transistor, a substrate of the second MOS transistor, and a substrate of the third MOS transistor are electrically connected to the third node.

4. The voltage regulator according to claim 1, wherein the second voltage regulation circuit comprises a fourth metal-oxide-semiconductor (MOS) transistor, a fifth MOS transistor, and a sixth MOS transistor; wherein a gate of the fourth MOS transistor is electrically connected to the second node, a first electrode of the fourth MOS transistor is electrically connected to the first power supply, and a second electrode of the fourth MOS transistor is electrically connected to the stable voltage output terminal;

a gate of the fifth MOS transistor is electrically connected to the voltage detection circuit and is configured to receive the second control signal or the fourth control signal, a first electrode of the fifth MOS transistor is electrically connected to the first power supply, and a second electrode of the fifth MOS transistor is electrically connected to a first electrode of the sixth MOS transistor through a fourth node; and a gate of the sixth MOS transistor is electrically connected to the voltage detection circuit and is configured to receive the first control signal or the third control signal and a second electrode of the sixth MOS transistor is electrically connected to the stable voltage output terminal;

wherein a substrate of the fourth MOS transistor, a substrate of the fifth MOS transistor, and a substrate of the sixth MOS transistor are electrically connected to the fourth node.

5. The voltage regulator according to claim 1, wherein the first switch circuit comprises a seventh metal-oxide-semiconductor (MOS) transistor and the second switch circuit comprises an eighth MOS transistor; wherein a gate of the seventh MOS transistor is electrically connected to the voltage detection circuit and is configured to receive the first control signal or the third control signal, a first electrode of the seventh MOS transistor is electrically connected to the first node, and a second electrode of the seventh MOS transistor is electrically connected to the second node; and a gate of the eighth MOS transistor is electrically connected to the voltage detection circuit and is configured to receive the first control signal or the third control signal, a first electrode of the eighth MOS transistor is electrically connected to the second node, and a second electrode of the eighth MOS transistor is electrically connected to the stable voltage output terminal.

6. The voltage regulator according to claim 5, wherein the seventh MOS transistor and the eighth MOS transistor have different channel types.

7. The voltage regulator according to claim 1, wherein the voltage regulation circuit comprises a ninth metal-oxide-semiconductor (MOS) transistor, a tenth MOS transistor, and an eleventh MOS transistor; wherein a gate of the ninth MOS transistor is electrically connected to the voltage detection circuit and is configured to receive the first control signal or the third control signal, a first electrode of the ninth MOS transistor is electrically connected to the second power supply, and a second electrode of the ninth MOS transistor is electrically connected to the stable voltage output terminal;

a gate of the tenth MOS transistor is electrically connected to the voltage detection circuit and is configured to receive the first control signal or the third control signal, a first electrode of the tenth MOS transistor is electrically connected to the second power supply, and a second electrode of the tenth MOS transistor is electrically connected to a first electrode of the eleventh MOS transistor through a fifth node; and a gate of the eleventh MOS transistor is electrically connected to the voltage detection circuit and is configured to receive the second control signal or the fourth control signal and a second electrode of the eleventh MOS transistor is electrically connected to the stable voltage output terminal;

wherein a substrate of the ninth MOS transistor, a substrate of the tenth MOS transistor, and a substrate of the eleventh MOS transistor are electrically connected to the fifth node.

8. The voltage regulator according to claim 1, wherein the error amplification circuit comprises an error amplifier, a first resistor, and a second resistor; wherein a first power terminal of the error amplifier is electrically connected to the first power supply, a second power terminal of the error amplifier is grounded, an output terminal of the error amplifier is electrically connected to the stable voltage output terminal through the loop current prevention circuit, a non-inverting input terminal of the error amplifier is electrically connected to a reference power supply, and an inverting input terminal of the error amplifier is electrically connected to the stable voltage output terminal through the first resistor and grounded through the second resistor.

9. The voltage regulator according to claim 1, wherein the error amplification circuit comprises an error amplifier, a control circuit, a current mirror circuit, a first load circuit, and a second load circuit; wherein a first power terminal of the error amplifier is electrically connected to the first power supply, a second power terminal of the error amplifier is grounded, a non-inverting input terminal of the error amplifier is electrically connected to a reference power supply, and an inverting input terminal of the error amplifier is electrically connected to an output terminal of the control circuit;

a control terminal of the control circuit is electrically connected to an output terminal of the error amplifier and an input terminal of the control circuit is electrically connected to the first power supply; the control circuit is configured to feed back a voltage signal of the first power supply to the inverting input terminal of the error amplifier according to a signal outputted from the error amplifier; and the current mirror circuit comprises a twelfth metal-oxide-semiconductor (MOS) transistor and a thirteenth MOS transistor; wherein a gate of the twelfth MOS transistor is electrically connected to a gate of the thirteenth MOS transistor, a first electrode of the twelfth MOS transistor is electrically connected to the inverting input terminal of the error amplifier, and a second electrode of the twelfth MOS transistor is grounded through the first load circuit and electrically connected to the gate of the twelfth MOS transistor; and a first electrode of the thirteenth MOS transistor is electrically connected to the stable voltage output terminal, and a second electrode of the thirteenth MOS transistor is grounded through the second load circuit and electrically connected to the loop current prevention circuit.

10. The voltage regulator according to claim 9, wherein the first load circuit comprises a fourteenth MOS transistor and the second load circuit comprises a fifteenth MOS transistor; wherein a gate of the fourteenth MOS transistor and a gate of the fifteenth MOS transistor are electrically connected to a bias power supply; a first electrode of the fourteenth MOS transistor is electrically connected to the second electrode of the twelfth MOS transistor and a second electrode of the fourteenth MOS transistor is grounded; and a first electrode of the fifteenth MOS transistor is electrically connected to the second electrode of the thirteenth MOS transistor and a second electrode of the fifteenth MOS transistor is grounded.

11. The voltage regulator according to claim 9, wherein the control circuit comprises a sixteenth MOS transistor; wherein a gate of the sixteenth MOS transistor is electrically connected to the output terminal of the error amplifier, a first electrode of the sixteenth MOS transistor is electrically connected to the first power supply, and a second electrode of the sixteenth MOS transistor is electrically connected to the inverting input terminal of the error amplifier.

12. A silicon-based display panel, comprising a silicon-based substrate, a display circuit, and a voltage regulator; wherein the voltage regulator and the display circuit are formed on the silicon-based substrate and the voltage regulator is configured to provide a stable voltage signal for the display circuit;

the voltage regulator comprises an error amplification circuit, a voltage detection circuit, a loop current prevention circuit, a voltage regulation circuit, and a stable voltage output terminal;

the voltage detection circuit is electrically connected to a first power supply, a second power supply, the loop current prevention circuit, and the voltage regulation circuit, separately; the voltage detection circuit is configured to output a first control signal and a second control signal to the loop current prevention circuit and the voltage regulation circuit when a voltage of the first power supply is lower than a voltage of the second power supply and output a third control signal and a fourth control signal to the loop current prevention circuit and the voltage regulation circuit when the voltage of the first power supply is higher than the voltage of the second power supply;

the voltage regulation circuit is further electrically connected between the second power supply and the stable voltage output terminal; the voltage regulation circuit is configured to output the voltage of the second power supply to the stable voltage output terminal when receiving the first control signal and the second control signal and stop outputting the voltage of the second power supply to the stable voltage output terminal when receiving the third control signal and the fourth control signal; and the loop current prevention circuit comprises: a first voltage regulation circuit a second voltage regulation circuit, a first switch circuit, and a second switch circuit; wherein the first voltage regulation circuit is electrically connected to the error amplification circuit, the first power supply, the second voltage regulation circuit, and the voltage detection circuit, separately, wherein the first voltage regulation circuit is electrically connected to the error amplification circuit through a first node and electrically connected to the second voltage regulation circuit through a second node;

the first voltage regulation circuit is configured to prevent a voltage at the first node and a voltage signal of the first power supply from being transmitted to the second node when receiving the first control signal and the second control signal and control the voltage at the first node to be transmitted to the second node and prevent the voltage signal of the first power supply from being transmitted to the second node when receiving the third control signal and the fourth control signal;

the first switch circuit is electrically connected to the voltage detection circuit, the first node, and the second node, separately; the first switch circuit is configured to receive the first control signal or the third control signal turn off when receiving the first control signal to prevent the voltage at the first node from being transmitted to the second node, and turn on when receiving the third control signal to enable the voltage at the first node to be transmitted to the second node;

the second switch circuit is electrically connected to the voltage detection circuit the second node, and the stable voltage output terminal separately; the second switch circuit is configured to receive the first control signal or the third control signal connect the second node to the stable voltage output terminal when receiving the first control signal and disconnect the second node from the stable voltage output terminal when receiving the third control signal; and the second voltage regulation circuit is electrically connected to the voltage detection circuit the first power supply, the second node, and the stable voltage output terminal; the second voltage regulation circuit is configured to prevent the voltage signal of the first power supply from being transmitted to the stable voltage output terminal when receiving the first control signal and the second control signal and adjust a signal of the stable voltage output terminal to the error amplification signal when receiving the third control signal and the fourth control signal; and wherein a voltage of the error amplification signal is higher than the voltage of the second power supply.

13. The silicon-based display panel according to claim 12, wherein the voltage detection circuit comprises a comparator circuit and an inverter; wherein a first input terminal of the comparator circuit is electrically connected to the first power supply, a second input terminal of the comparator circuit is electrically connected to the second power supply, and a first output terminal of the comparator circuit is electrically connected to an input terminal of the inverter; a first power terminal of the comparator circuit is electrically connected to the first power supply and a second power terminal of the comparator circuit is grounded; the comparator circuit is configured to output the first control signal to the inverter, the loop current prevention circuit, and the voltage regulation circuit when the voltage of the first power supply is lower than the voltage of the second power supply and output the third control signal to the inverter, the loop current prevention circuit, and the voltage regulation circuit when the first power supply is higher than the second power supply;

a high-level signal terminal of the inverter is electrically connected to the second power supply and a low-level signal terminal of the inverter is grounded; and the inverter is configured to output the second control signal to the loop current prevention circuit and the voltage regulation circuit when receiving the first control signal and output the fourth control signal to the loop current prevention circuit and the voltage regulation circuit when receiving the third control signal;

wherein the first control signal and the fourth control signal are low-level signals, the second control signal is a voltage signal of the second power supply, and the third control signal is a voltage signal of the first power supply.

14. The silicon-based display panel according to claim 12, wherein the first voltage regulation circuit comprises a first metal-oxide-semiconductor (MOS) transistor, a second MOS transistor, and a third MOS transistor; wherein a gate of the first MOS transistor is electrically connected to the voltage detection circuit and is configured to receive the second control signal or the fourth control signal, a first electrode of the first MOS transistor is electrically connected to the first node, and a second electrode of the first MOS transistor is electrically connected to the second node;

a gate of the second MOS transistor is electrically connected to the voltage detection circuit and is configured to receive the second control signal or the fourth control signal, a first electrode of the second MOS transistor is electrically connected to the first power supply, and a second electrode of the second MOS transistor is electrically connected to a first electrode of the third MOS transistor through a third node;

a gate of the third MOS transistor is electrically connected to the voltage detection circuit and is configured to receive the first control signal or the third control signal and a second electrode of the third MOS transistor is electrically connected to the second node; and a substrate of the first MOS transistor, a substrate of the second MOS transistor, and a substrate of the third MOS transistor are electrically connected to the third node.

15. The silicon-based display panel according to claim 12, wherein the second voltage regulation circuit comprises a fourth metal-oxide-semiconductor (MOS) transistor, a fifth MOS transistor, and a sixth MOS transistor; wherein a gate of the fourth MOS transistor is electrically connected to the second node, a first electrode of the fourth MOS transistor is electrically connected to the first power supply, and a second electrode of the fourth MOS transistor is electrically connected to the stable voltage output terminal;

a gate of the fifth MOS transistor is electrically connected to the voltage detection circuit and is configured to receive the second control signal or the fourth control signal, a first electrode of the fifth MOS transistor is electrically connected to the first power supply, and a second electrode of the fifth MOS transistor is electrically connected to a first electrode of the sixth MOS transistor through a fourth node; and a gate of the sixth MOS transistor is electrically connected to the voltage detection circuit and is configured to receive the first control signal or the third control signal and a second electrode of the sixth MOS transistor is electrically connected to the stable voltage output terminal;

wherein a substrate of the fourth MOS transistor, a substrate of the fifth MOS transistor, and a substrate of the sixth MOS transistor are electrically connected to the fourth node.

16. The silicon-based display panel according to claim 12, wherein the first switch circuit comprises a seventh metal-oxide-semiconductor (MOS) transistor and the second switch circuit comprises an eighth MOS transistor; wherein a gate of the seventh MOS transistor is electrically connected to the voltage detection circuit and is configured to receive the first control signal or the third control signal, a first electrode of the seventh MOS transistor is electrically connected to the first node, and a second electrode of the seventh MOS transistor is electrically connected to the second node; and a gate of the eighth MOS transistor is electrically connected to the voltage detection circuit and is configured to receive the first control signal or the third control signal, a first electrode of the eighth MOS transistor is electrically connected to the second node, and a second electrode of the eighth MOS transistor is electrically connected to the stable voltage output terminal.

17. The silicon-based display panel according to claim 16, wherein the seventh MOS transistor and the eighth MOS transistor have different channel types.

18. The silicon-based display panel according to claim 12, wherein the voltage regulation circuit comprises a ninth metal-oxide-semiconductor (MOS) transistor, a tenth MOS transistor, and an eleventh MOS transistor; wherein a gate of the ninth MOS transistor is electrically connected to the voltage detection circuit and is configured to receive the first control signal or the third control signal, a first electrode of the ninth MOS transistor is electrically connected to the second power supply, and a second electrode of the ninth MOS transistor is electrically connected to the stable voltage output terminal;

a gate of the tenth MOS transistor is electrically connected to the voltage detection circuit and is configured to receive the first control signal or the third control signal, a first electrode of the tenth MOS transistor is electrically connected to the second power supply, and a second electrode of the tenth MOS transistor is electrically connected to a first electrode of the eleventh MOS transistor through a fifth node; and a gate of the eleventh MOS transistor is electrically connected to the voltage detection circuit and is configured to receive the second control signal or the fourth control signal and a second electrode of the eleventh MOS transistor is electrically connected to the stable voltage output terminal;

wherein a substrate of the ninth MOS transistor, a substrate of the tenth MOS transistor, and a substrate of the eleventh MOS transistor are electrically connected to the fifth node.

* * * * *